US005285025A

United States Patent [19]

Yoshioka

[11] Patent Number: 5,285,025

[45] Date of Patent: Feb. 8, 1994

[54] LOUDSPEAKER HORN

[75] Inventor: Tsutomu Yoshioka, Hyogo, Japan

[73] Assignee: Toa Corporation, Hyogo, Japan

[21] Appl. No.: 514,983

[22] Filed: Apr. 26, 1990

[30] Foreign Application Priority Data

Apr. 27, 1989 [JP] Japan ..... 1-111781

[51] Int. Cl.[5] ..... G10K 11/00; G10K 13/00

[52] U.S. Cl. ..... 181/192; 181/159

[58] Field of Search ..... 181/177, 193, 195, 159, 181/187, 192; 381/156

[56] References Cited

U.S. PATENT DOCUMENTS

| | | | |
|---|---|---|---|
| 4,071,112 | 1/1978 | Keele, Jr. | 191/187 |
| 4,187,926 | 2/1980 | Hendrickson | 181/192 |
| 4,308,932 | 1/1982 | Keele, Jr. | 181/187 |
| 4,390,078 | 6/1983 | Howze et al. | 181/195 XR |
| 4,465,160 | 8/1984 | Kawamura | 181/192 |

FOREIGN PATENT DOCUMENTS

| | | |
|---|---|---|
| 7708367 | 10/1977 | France . |
| 1494672 | 12/1977 | United Kingdom . |
| 2120508A | 11/1983 | United Kingdom . |

OTHER PUBLICATIONS

Herrmann, Handbuch der Elektroakustik, 1978, pp. 98-101.

Abstracts, Horn Speaker (Appl. No. 60-53092, 61-212198(A) Japan.

Journal of the Audio Eng. Society Sep. 1978 vol. 26, No. 9, pp. 629-634 "The Marta Ray Horns".

Journal of Audio Eng. Soc. Jun. 1983 vol. 31, No. 6, pp. 408-422 "Improv. in Monitor Loud Speaker".

*Primary Examiner*—Michael L. Gellner

*Assistant Examiner*—Jae N. Noh

*Attorney, Agent, or Firm*—Townsend and Townsend Khourie and Crew

[57] ABSTRACT

A speaker horn including a first and a second pair of side walls. The first pair of side walls has a first section and a second section between first and second ends, and the second pair of side walls has a third section and a fourth section between third and fourth ends. The first pair of side walls has, in a first plane including the central axis of the horn and perpendicular to the side walls of the first pair, a shape defined by the following equation:

$$y=a+b\cdot e^{cx}$$

where a, b and c are constants and have values different in said first and said second sections, and the second pair of side walls is, in a second plane including the central axis of the horn and perpendicular to the side walls of the second pair, linear in the third section and an arc in the fourth section.

9 Claims, 15 Drawing Sheets

LOUDSPEAKER HORN

BACKGROUND OF THE INVENTION

1. Field of the Invention

The present invention generally relates to a loudspeaker horn, and, more specifically, to a loudspeaker horn having a constant directivity over a wide frequency range.

2. Description of the Prior Art

U.S. Pat. No. 4,187,926 issued to C. A. Henricksen et al. on Feb. 12, 1980, Japanese Patent Public Disclosure No. 6875/82 and C. A. Henricksen et al. "The Manta-Ray Horns", JOURNAL OF THE AUDIO ENGINEERING SOCIETY, September 1978, Volume 26, Number 9, p. 629–634 respectively disclose a horn as shown in FIGS. 1*a* and 1*b*. Such a horn has vertical and horizontal side walls which have linear configurations expressed by such equations as $y=ax+b$. This type of horn has the advantage of an easily controlled directivity angle, but has the disadvantage that radiation characteristics in a low frequency range of the horn become distorted because the cross-sectional area of the horn resembles a conical horn.

Japanese Patent Public Disclosure No. 76995/82 discloses a horn as shown in FIGS. 2*a* and 2*b*. The side wall of such a horn is expressed by $y=a_0(1+\alpha x)^n$, where n assumes $n_1$ (>2) at the side of the horn aperture and $n_2$ ($>n_1$) at the side of throat. This type of horn is advantageous in that radiation characteristics in a low frequency range are less distorted since the side wall of the horn is formed by two kinds of Besser functions and the cross-sectional area of the horn extends near exponentially. On the other hand, this type of horn has a disadvantage in that it is difficult to control its directivity angle because the included angle of the horn starts to change from the throat end and there is an uncertainty as to where the two curves should best intersect.

Japanese Patent Public Disclosure No. 212198/86 discloses another type of horn as shown in FIG. 3. Such a horn has side walls each formed in an arc. This results in a near exponential rate of increase in cross section and produces good radiation characteristics in a low frequency range of the horn, but does not provide any solution for the control of the directivity angle of the horn.

SUMMARY OF THE INVENTION

Accordingly, the present invention has been made in order to overcome the above-described problems.

It is an object of the invention to provide a speaker horn having characteristics of a more uniform directivity and a higher sound pressure over a wide frequency range.

According to a feature of the invention, a speaker horn according to the present invention includes a first pair of opposing side walls and a second pair of opposing side walls substantially perpendicular to the first pair of opposing side walls. The first pair of opposing side walls has a first section and a second section between the first and second ends, and the second section is connected to the first section. The first end of the first pair of opposing side walls is coupled to a driver unit. The second end of the first pair of opposing side walls defines a mouth of the horn, and the first pair of opposing side walls has, in a plane including the central axis of the horn and perpendicular to the side walls of the first pair, a shape defined by the following equation:

$$y=a+b\cdot e^{cx}$$

where a, b and c are constants and have values different in the first and the second sections.

By forming the first pair of opposing side walls to have such a shape as defined by the equation having a constant term and an exponential term, it is possible to maintain a uniform directivity angle characteristic over a wide frequency range in the plane including the central axis of the horn and perpendicular to the opposing side walls of the first pair and to obtain a high sound pressure, especially in low and middle frequency ranges.

In an embodiment of a horn according to the present invention, a differential coefficient of the above-described equation for the first section is equal to that for the second section at the boundary of the first and the second sections. The second pair of opposing side walls may have the same shape as the first pair.

According to another feature of the invention, a speaker horn according to the present invention includes a first pair of opposing side walls and a second pair of opposing side walls substantially perpendicular to the first pair of opposing side walls. The first pair of opposing side walls has a first section and a second section between its first and second ends, and the second section is connected to the first section. The first end of the first pair of opposing side walls is coupled to a driver unit, and the second end of the first pair of opposing side walls defines a mouth of the horn. The first pair of opposing side walls is, in a plane including the central axis of the horn and perpendicular to the first pair of opposing side walls, linear in the first section and arc in the second section.

By forming the first pair of opposing side walls to have the linear first section and the arc second section, it is possible to enable a sound wave to smoothly emanate from the mouth of the horn. Preferably, the length of the second section of the first pair is about one half of the total length thereof. When the teaching of the present invention is applied to a pair of horizontal opposing side walls of a horn to control vertical directivity thereof, a narrowing phenomenon can be avoided and a uniform directivity angle characteristic can be obtained over a wide frequency range even though vertical directivity is generally narrow and requires more accurate control.

In another embodiment of a horn according to the present invention, lines running on the linear side wall portions of the first section are tangential to the side walls in the second section at the boundary of the first and second sections. The second pair of opposing side walls may have the same shape as the first pair.

According to a still another feature of the invention, a speaker horn according to the present invention includes a first pair of opposing side walls and a second pair of opposing side walls substantially perpendicular to the first pair of opposing side walls. The first pair of opposing side walls has a first section and a second section between its first and second ends, and the second section is connected to the first section. The second pair of opposing side walls has a third section and a fourth section between its third and fourth ends, and the third section is connected to the fourth section. The first and third ends are coupled to a driver unit and the second and fourth ends form a mouth of the horn. The first pair of opposing side walls has, in a first plane including the central axis of the horn and perpendicular to the side walls of the first pair, a shape defined by the following equation:

$$y=a+b\cdot e^{cx}$$

where a, b and c are constants and have values different in the first and the second sections, and the second pair of opposing side walls is, in a second plane including the central axis of the horn and perpendicular to the side walls of the second pair, linear in the third section and an arc in the fourth section.

In still another embodiment of a horn according to the present invention, a differential value of the equation for the first section is equal to that for the second section at the boundary of the first and the second sections in the first plane, and, the lines running on the side walls in the third section are tangent to the side walls in the fourth section at the boundary of the third and fourth sections in the second plane.

In those embodiments of the invention, it is preferable to form the mouth of the horn in conformity with an equiphase line of a sound wave propagating inside the horn.

Other features and advantages of the present invention will become clear from the following description made by way of example with reference to the accompanying drawings.

DESCRIPTION OF PREFERRED EMBODIMENTS

Figure 1A:
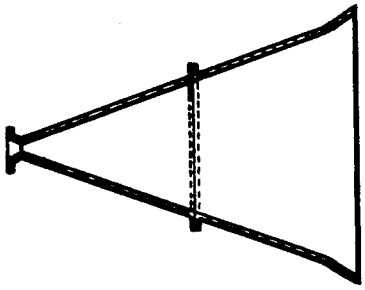
Fig. 1(a) (PRIOR ART)
FIGS. 1*a* and 1*b* schematically show horizontal and vertical cross sections, respectively, of a conventional horn having linear horizontal side walls and linear vertical side walls.
Figure 1B:
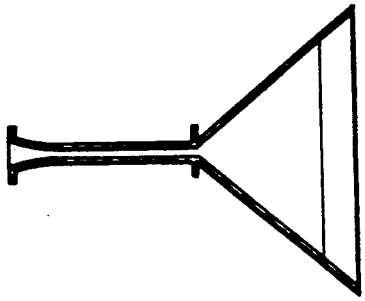
Fig. 1(b) (PRIOR ART)
Figure 2A:
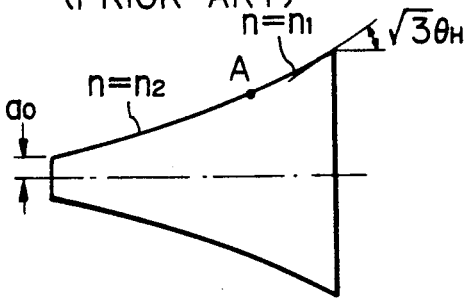
Fig. 2(a) (PRIOR ART)
FIGS. 2*a* and 2*b* schematically show horizontal and vertical cross sections, respectively, of another conventional horn having horizontal and vertical side walls both defined by a combination of different polynomials.
Figure 2B:
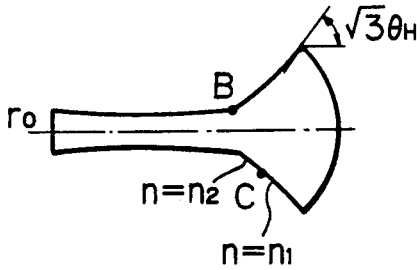
Fig. 2(b) (PRIOR ART)
Figure 3:
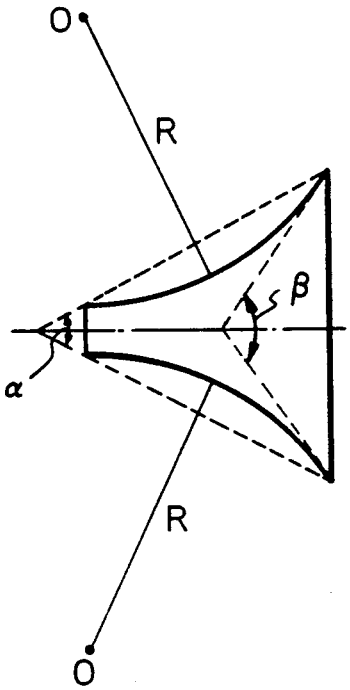
Fig. 3 (PRIOR ART)
FIG. 3 schematically shows a horizontal cross section of a still another conventional horn having arched side walls.
Figure 4:
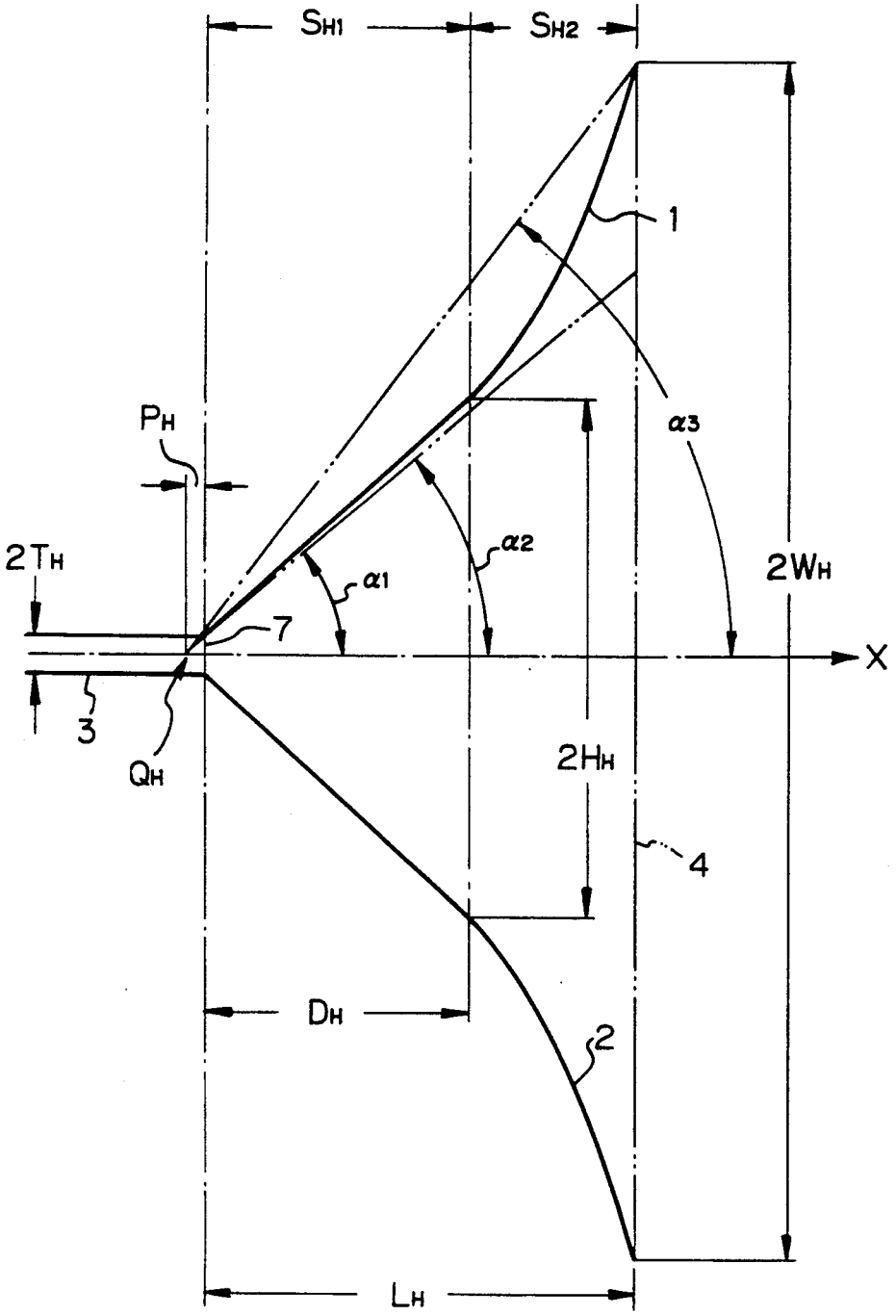
FIG. 4 schematically shows a horizontal cross section of an embodiment of a horn according to the present invention.
Figure 5:
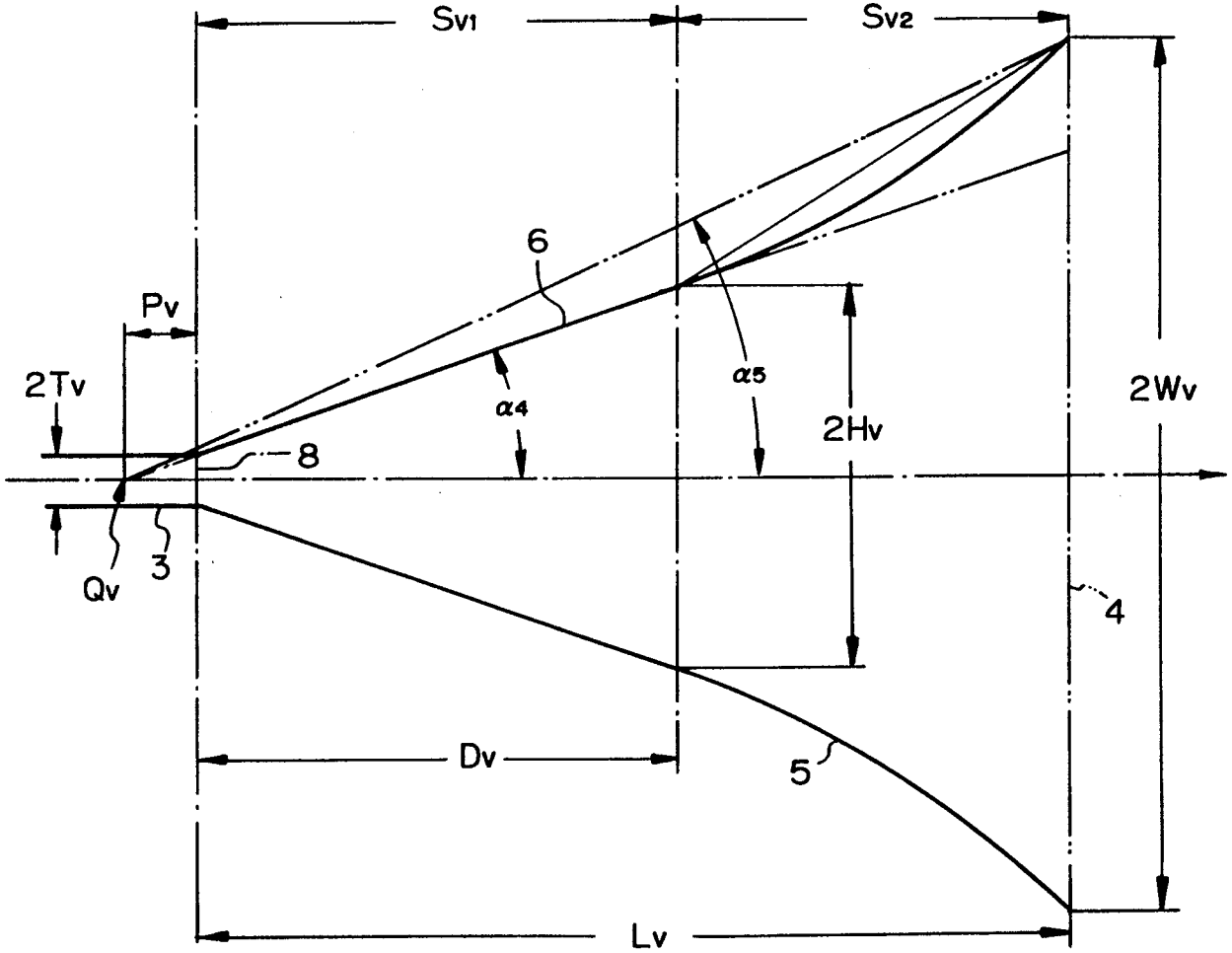
FIG. 5 schematically shows a vertical cross section of the horn shown in FIG. 4.

FIGS. 4 and 5 show cross sections of an embodiment of a horn according to the present invention in horizontal and vertical planes including the central axis of the horn.

As shown in FIG. 4, a basic form of vertical side walls 1 and 2, defining a first pair of opposing side walls, are disposed symmetrically with respect of the central axis X of the horn in the horizontal cross section in order to control a horizontal directivity. The vertical side walls 1 and 2 are divided into a first section $S_{H1}$ connected to a throat portion 3 and a second section $S_{H2}$ ending at a horn mouth 4. The vertical side walls 1 and 2 are defined by the following equations (1) and (2) in the first and second sections $S_{H1}$ and $S_{H2}$, respectively.

$$y=a_1+b_1\cdot e^{c1x} \quad (1)$$

$$y=a_2+b_2\cdot e^{c2x} \quad (2)$$

These equations include constant terms and exponential terms.

FIG. 5 shows a basic form of horizontal side walls 5 and 6, defining a second pair of opposing side walls, symmetrically disposed with respect to the central axis X of the horn in the vertical cross section in order to control a vertical directivity. The horizontal side walls 5 and 6 are divided into a first section $S_{V1}$ connected to a throat portion 3 and a second section $S_{V2}$ ending at the horn mouth 4.

The first and the second sections $S_{V1}$ and $S_{V2}$ take forms defined by the following equations (3) and (4), respectively.

$$y = a_3 + b_3x \quad (3)$$

$$y = b_4 \pm \sqrt{\gamma^2 - (x - a_4)^2} \quad (4)$$

As seen from the equations (3) and (4), the first section $S_{V1}$ is in the form of a straight line and the second section $S_{V2}$ is in the form of an arc. In other words, in this embodiment the form of the vertical side walls 1 and 2 of the horn is expressed by mathematical equations different from those defining the form of the horizontal side walls 5 and 6. The reason therefor is that it is intended to control the vertical directivity (in general, having a narrower directivity angle) in a more accurate manner and to make the radiation resistance in a low frequency range flatter in the horizontal direction while controlling the horizontal directivity (in general, having a wider directivity angle). It is noted, however, that the first and second pairs of opposing side walls side walls may be constructed to have the same configuration by using the first pair of equations (1) and (2) or the second pair of equations (3) and (4).

It is known that conical horns having linear side walls are, in general, excellent in controlling the directivity. Accordingly, the horn according to the present invention makes use of a conical horn as a basic form for the purpose of controlling vertical directivity. Conical horns, however, have a disadvantage in that the directivity angle becomes narrower than a designed value in a low frequency range. This is known as a narrowing phenomenon. For example, at a frequency of 630 Hz the actual directivity angle is 60 degrees in contrast with a designed value of 90 degrees. Such a phenomenon occurs because the side walls of the conical horn at the mouth end are linear whereby a secondary sound is produced by diffraction and causes a phase interference with a primary sound. In order to inhibit such a narrowing phenomenon from occurring, the second section $S_{V2}$ of the horizontal side walls 5 and 6 of the horn is, as shown in FIG. 5 and described earlier, in the form of an arc so that a sound wave emanates more evenly from the horn mouth 4.

As noted earlier, it is possible to form the vertical side walls 1 and 2 such that the first and second sections $S_{H1}$ and $S_{H2}$ of these side walls are linear and in the form of an arc, respectively. In this case, however, the radiation resistance in a low frequency range is almost equal to that of a conical horn and lower than that of an exponential horn. Since an exponential horn cannot have a constant directivity, the horn according to the present invention has a form as described above in order to resemble the exponential horn as closely as possible while maintaining a constant directivity.

Further, according to the present invention, the horn is constructed such that sound waves emanating from virtual sound sources $Q_H$ and $Q_V$ (FIGS. 6*a* and 6*b*) are propagated concentrically inside the horn as shown by the dotted lines. In addition, the sound wave leaves, at the same time, the mouth end of the vertical side walls and the mouth end of the horizontal side walls. Accordingly, a more uniform radiation pattern can be achieved and the axial length of the horn can be shortened in comparison with the prior art.

Various parameters for defining the shape of the vertical side walls 1 and 2 (FIG. 4) of the horn are determined as follows. In this case, it is assumed that as desired performances of the horn, a desired directivity angle is designated by $2\alpha$ (degrees), the directivity controlling upper and lower limit frequencies being designated by $F_H$ (Hz) and $F_L$ (Hz), respectively.

(1) A tangential angle $\alpha_1$ at a slit 7:

$$\alpha_1/\alpha = 0.87 \sim 0.9$$

The virtual sound source $Q_H$ is assumed to be at an intersection of the tangent at the slit 7 with the central axis X of the horn.

(2) The horizontal width $2T_H$ of the slit 7:

$$T_H \leqq 103.8/(F_H \cdot \sin\alpha)[\mathrm{m}]$$

(3) The horizontal length $2W_H$ of the horn mouth 4:

$$W_H \geqq 103.8/(F_L \cdot \sin\alpha)[\mathrm{m}]$$

(4) An angle $\alpha_3$ between the central axis X of the horn and a line interconnecting the virtual sound source $Q_H$ and one end point of the horn mouth 4:

$$\alpha_3/\alpha = 1.17 \sim 1.21$$

(5) The length $L_H$ along the central axis X of the horn between the slit 7 and the mouth 4:

$$L_H = W_H/\tan\alpha_3 - P_H[\mathrm{m}]$$

where $P_H = T_H/\tan\alpha_1$ (6) The length $D_H$ of the first section $S_{H1}$ along the central axis X of the horn:

$$D_H/L_H = 0.56 \sim 0.62$$

(7) An angle $\alpha_2$ between the central axis X of the horn and a line interconnecting the virtual sound source $Q_H$ and one end point of the side walls 1 and 2 of the first sections:

$$\alpha_2/\alpha = 0.9 \sim 0.95$$

$$\alpha_2 > \alpha_1$$

(8) The horizontal width $2H_H$ of the boundary of the first and second sections $S_{H1}$ and $S_{H2}$:

$$H_H = (D_H + P_H)\tan\alpha_2[\mathrm{m}]$$

$$P_H = T_H/\tan\alpha_1$$

On the basis of such conditions as described above, the respective constants $a_1$, $b_1$, $c_1$, $a_2b_2$ and $c_2$ of the basic equations (1) and (2) for the first and second sections $S_{H1}$ and $S_{H2}$ are determined as follows:

(9) In determining the constants $a_1$, $b_1$ and $c_1$ of the equation "$y = a_1 + b_1e^{c_1x}$" for the first section $S_{H1}$:
When $x=0$, then $y=T_H$ and $dy/dx = \tan\alpha_1$.
When $x=D_H$, then $y=H_H$. Accordingly, $$\frac{1}{D_H} \cdot \ln\left(\frac{H_H - T_H}{b_1} + 1\right) - \frac{\tan\alpha_1}{b_1} = 0.$$

From this equation, the constant $b_1$ is obtained by a numerical calculation. When $b_1$ is determined, $a_1$ and $c_1$ are correspondingly determined by the following equations:

$$a_1 = T_H - b_1,\ c_1 = \tan\alpha_1/b_1$$

(10) In determining the constants $a_2$, $b_2$ and $c_2$ of the equation "$y = a_2 + b_2e^{c_2x}$" for the second section $S_{H2}$:
The x-coordinate of the starting point of the second section is assumed to be zero. When $x=0$, then $y=H_H$ and $dy/dx = a_1b_1e^{c_1D}H$. When $x = L_H - D_H$, then $y = W_H$. Therefore, $$\frac{1}{L_H - D_H} \cdot \ln\left(\frac{W_H - H_H}{b_2} + 1\right) - \frac{b_1c_1 \cdot e^{c_1D_H}}{b_2} = 0.$$

The constant $b_2$ can be obtained from the above equation by a numerical calculation. When the value of $b_2$ is determined, the remaining constants can be obtained from the following equations:

$$a_2 = H_H - b_2$$

$$c_2 = b_1c_1 \cdot e^{c_1D_H}/b_2$$

As described above, the respective constants of the basic equations are determined and the basic shape of the vertical side walls is determined.

Next, the method of determining the respective constants defining the shape of the horizontal side walls 5 and 6 of the horn is explained hereafter in reference to FIG. 5. In this case, desired performances ($2\alpha$, $F_H$ and $F_L$) are the same as those in determining the shape of the vertical side walls, but the values of the constants are not necessarily the same as those described with reference to FIG. 4.

(1) An angle $\alpha_4$ between the central axis X of the horn and one of the linear side wall portions of the first section $S_{V1}$:

$$\alpha_4/\alpha = 0.90 \sim 0.95$$

The virtual sound source $Q_V$ is positioned at an intersection of the central axis X of the horn and a straight line running on one of the linear side wall portions of the first section $S_{V1}$.

(2) The vertical width $2T_V$ of a slit 8:

$$T_V \leqq 103.8/(F_H \cdot \sin \alpha)[m]$$

If $2T_V$ is smaller than the diameter of a throat of a driver unit, the throat of the horn should be reduced to the same value as $2T_V$.

(3) The vertical width $2W_V$ of the horn mouth 4:

$$W_V \geqq 103.8/(F_L \cdot \sin \alpha)[m]$$

(4) An angle $\alpha_5$ between the central axis X of the horn and a straight line interconnecting the intersection $Q_V$ and one end point of the mouth 4:

$$\alpha_5/\alpha = 1.21 \sim 1.28$$

(5) The length $L_V$ along the central axis X of the horn between a slit 8 and the mouth 4:

$$L_V = W_V/\tan \alpha_5 - P_V[m]$$

$$P_V = T_V/\tan \alpha_3$$

(6) The length $D_V$ of the first section $S_{V1}$ along the central axis X of the horn:

$$D_V/L_V = 0.52 \sim 0.57$$

According to the conditions described in (1), (2) and (6), the straight line defining the first section $S_{V1}$ is determined.

(7) An arc defining the second section $S_{V2}$ is determined such that the arc is tangential to the straight line of the first section $S_{V1}$ at the starting point of the second section $S_{V2}$, the arc ending at the end point of the mouth 4.

In such a manner as described above, the basic shapes of the horizontal and vertical side walls of the horn are determined.

Figure 6A:
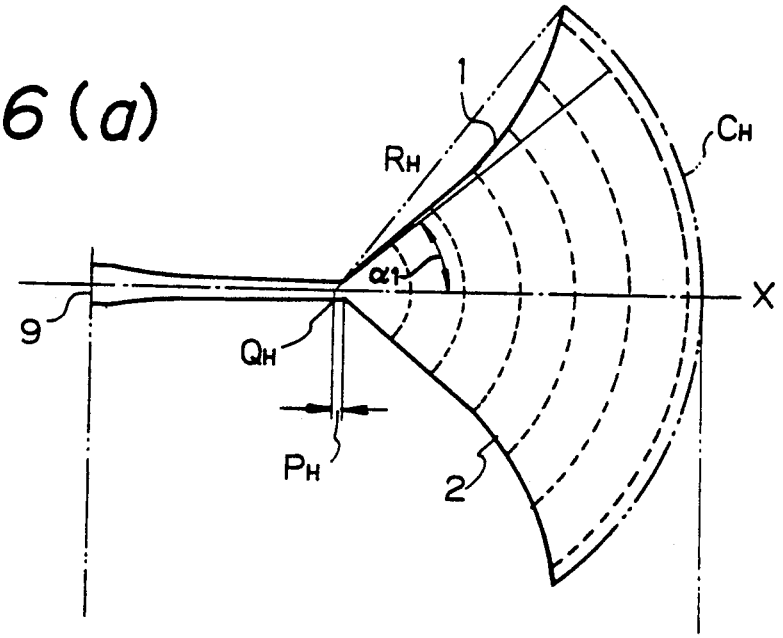
FIGS. 6*a* and 6*b* show a mutual positional relationship between the horizontal cross section shown in FIG. 4 and the vertical cross section shown in FIG. 5, along with sound waves propagating inside the horn.
Figure 6B:
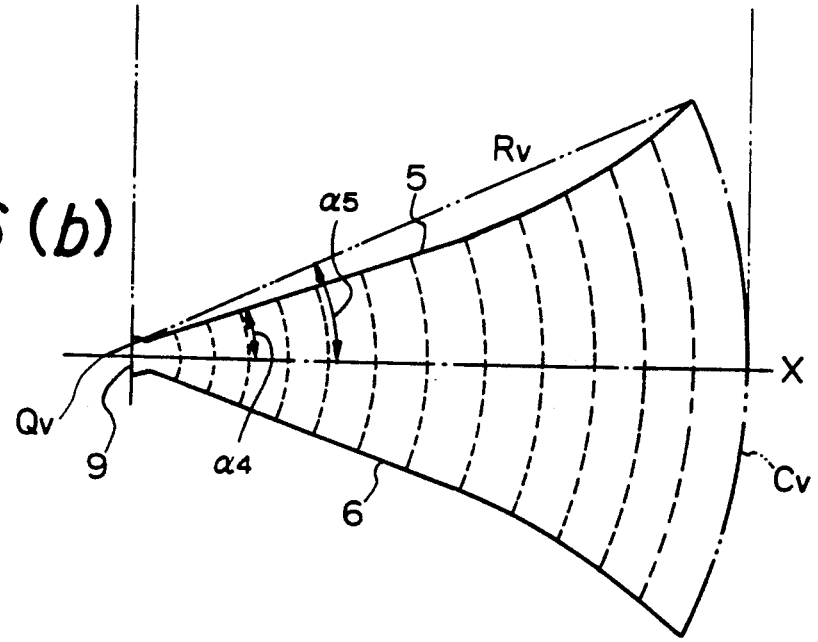
Figure 7:
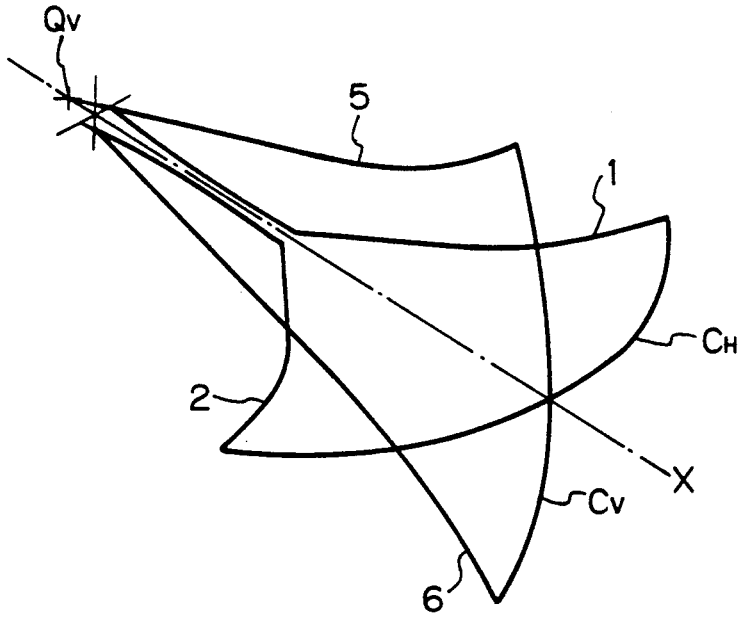
FIG. 7 shows a three-dimensional combination of the horizontal and vertical cross sections of the horn.
Figure 8B:
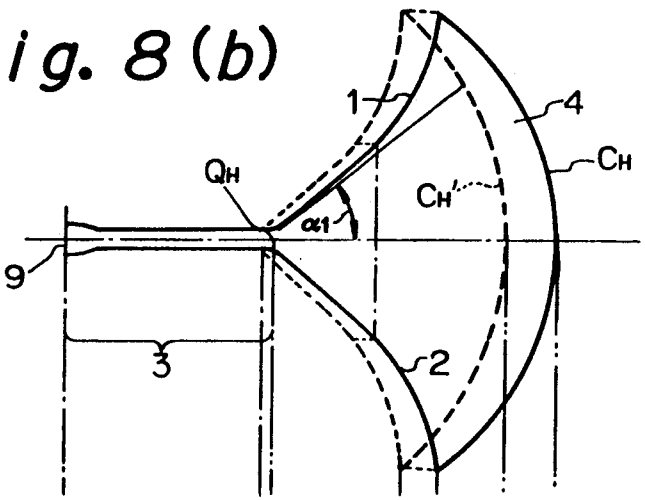
FIGS. 8*b* and 8*c* show a horizontal cross section of the horn taken along a line A—A and a vertical cross section of the horn taken along a line B—B, respectively.
Figure 8C:
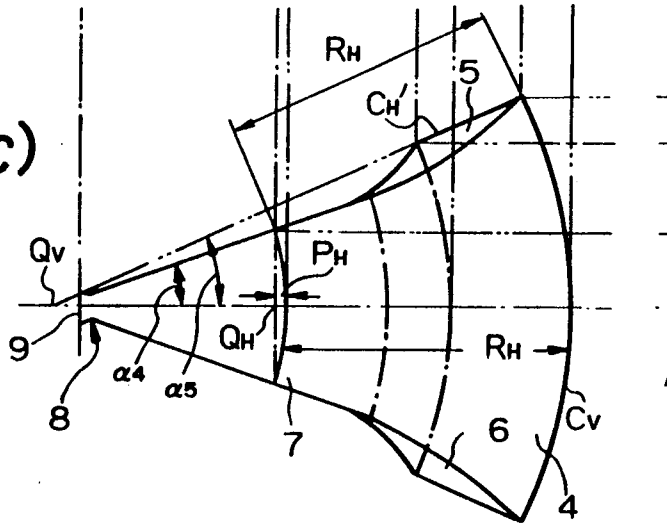
Figure 8A:
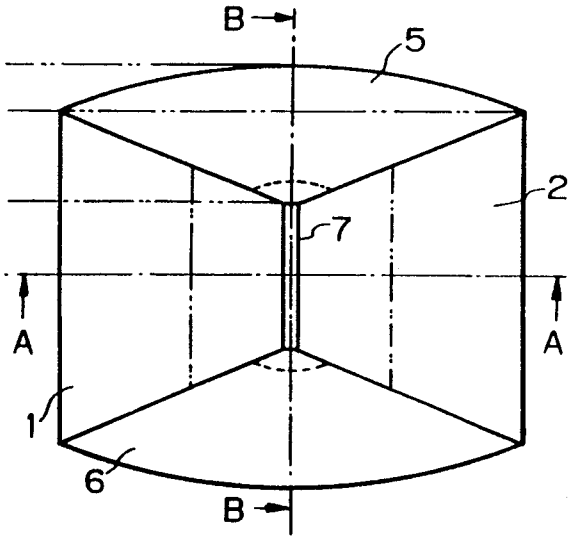
FIG. 8*a* is a front view of the embodiment of the horn according to the present invention.

In the final step, the curved surfaces of the opposing side walls are formed in such a manner as described below. It is assumed that sound waves propagate inside the horn concentrically from the virtual sound source $Q_H$ in the horizontal cross section and from the virtual sound source $Q_V$ in the vertical cross section, respectively. FIG. 6*a* shows a state when the sound wave emanated by the virtual sound source $Q_H$ has reached the mouth 4, and FIG. 6*b* shows a state when the sound wave emanating from the virtual sound source $Q_V$ has reached the mouth 4. In these figures, a reference numeral 9 designates a throat of the horn. It is noted that the positions of the vertical and horizontal side walls 1, 2; 5, 6 along the central axis of the horn are determined such that an intersection of the sound wave with the central axis X of the horn at the mouth 4 in the horizontal cross section coincides with an intersection of the sound wave with the central axis of the horn at the mouth 4 in the vertical cross section. FIG. 7 shows how the horizontal cross section of the horn (FIG. 6*a*) and the vertical cross section of the horn (FIG. 6*b*) are combined when the above-described conditions are satisfied. FIG. 8*a* is a front view of an actual form of the horn of this embodiment according to the present invention, and FIGS. 8*b* and 8*c* are cross sections taken along the lines A—A and B—B, respectively.

As shown in FIGS. 6*a*, 6*b*, 7, 8*a*, 8*b* and 8*c*, the wave fronts $C_H$ in the horizontal cross section and the wave fronts $C_V$ in the vertical cross section take such forms that those wave fronts $C_H$ and $C_V$ coincide with the wave fronts of the sound waves propagating inside the horn, that is, these edges $C_H$ and $C_V$ are respectively in the form of an arc.

Next, steps for actually constructing the vertical side walls 1 and 2 and the horizontal side walls 5 and 6 of the horn will be explained with reference to FIGS. 6*a*–10. In order to simplify the explanation of the steps, the method of constructing the upper halves of the vertical and horizontal side walls of the horn will be considered hereafter.

(I) As explained earlier with reference to FIGS. 4, 5, 6*a* and 6*b*, the horizontal and vertical cross sections have been determined and properly disposed as shown in FIG. 7.

(II) The horizontal cross section of the horn shown in FIG. 6*a* is rotated in the upper direction by an angle $\alpha_4$ about an axis $\Phi$ passing the virtual sound source $Q_V$ and perpendicular to the central axis X of the horn, thereby forming the first section $S_{V1}$ of the upper one of the horizontal side walls 5 and the corresponding portion of the vertical side walls. At this time, the slit 7 is in the form of arc between the vertical side walls 1 and 2, as shown in FIG. 8.

Figure 9:
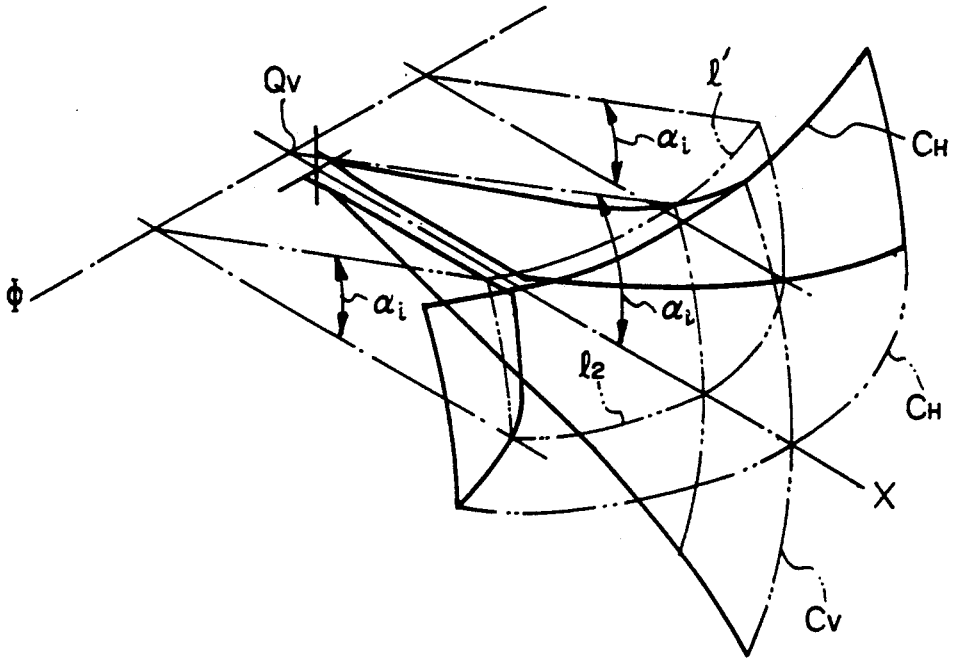
FIGS. 9 and 10 are used for explaining how the horizontal and vertical side walls are constructed.
Figure 10:
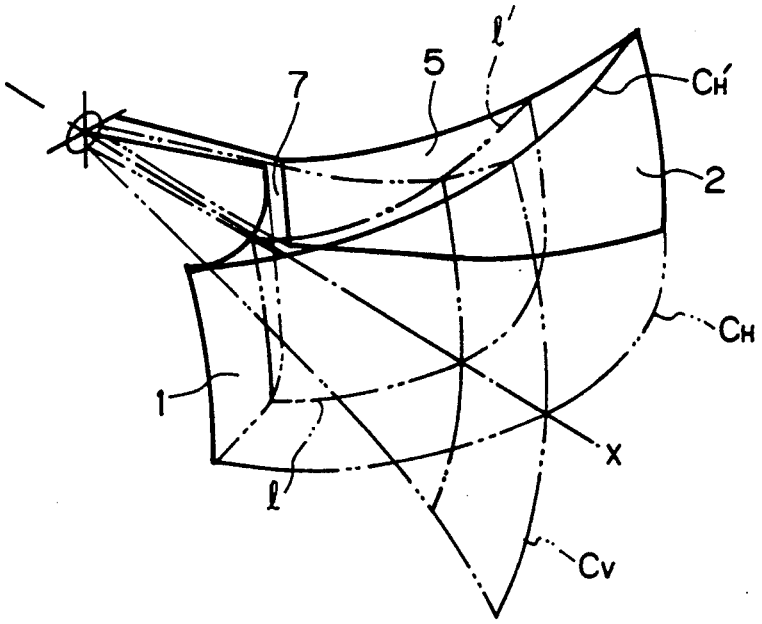

(III) The second section $S_{V2}$ of the upper one of the horizontal side walls 5 is determined as follows:

In the horizontal cross section, a multiplicity of concentric arcs placing the center at the virtual sound source $Q_H$ are assumed between the slit 7 and the wave front $C_H$ as shown in FIG. 6*a*. Then, these concentric arcs are rotated in the upper direction by an angle $\alpha_i$ ($\alpha_4 \leqq \alpha_i \leqq \alpha_5$) about the axis $\Phi$. Such rotation is ceased when the midpoint of each arc intersects the upper side line of the horizontal side wall 5 in the vertical cross section, and thus the respective arcs have moved so as to be at the horizontal side wall 5. The horizontal wave front $C_H$ is moved in the same direction by the angle $\alpha_5$ about the axis $\Phi$ to the upper end point of the vertical aperture edge $C_V$ to form the horizontal mouth edge $C'_H$ of the horizontal side wall 5 of the horn. FIG. 9 particularly shows this step. The horizontal wave front $C_H$ is rotated in the upper direction about the axis $\Phi$ by the angle $\alpha_5$ to the upper end point of the horizontal side wall. Thus the locus of the edge $C_H$ forms the upper half of the vertical mouth edge. Any one of the arcs l assumed on the horizontal cross section is rotated in the same direction about the axis $\Phi$ by the angle $\alpha_i$ to an arc l' which intersects the upper side line of the side wall 5 in the vertical cross section. Thus the resultant horizontal side wall 5 is formed as shown in FIG. 10.

(IV) The horizontal cross section of the horn shown in FIG. 6*a* is rotated in the upper direction by the angle $\alpha_5$ thereby forming the remaining vertical side walls as a succession of intersections of the loci of the horizontal cross section of the horn with the multiplicity of arcs positioned at the horizontal side wall 5 in step III. Thus the upper half of the total vertical side walls are constructed.

It should be noted that, in FIG. 8*b* the distance between the side walls of the throat portion 3 between the throat 9 and the slit 7 is determined in such a way as to increase the cross-sectional area exponentially.

By the steps as described above, the vertical and horizontal side walls 1, 2; 5, 6 are finally formed.

As a practical design, a constant directivity horn having the horizontal directivity angle of 90 degrees and the vertical directivity angle of 40 degrees has been constructed. The respective parameters of this horn are indicated as follows:

(1) Regarding the vertical side walls 1 and 2: $2\alpha=90°$, $\alpha_1=40.5°$ ($\alpha_1/\alpha=0.9$), $T_H=12.5$ (mm), $W_H=380$ (mm), $\alpha_3=53.2°$ ($\alpha_3/\alpha=1.18$), $L_H=274.5$ (mm), $D_H=170$ (mm) ($D_H/L_H=0.62$), $\alpha_2=41.9°$ ($\alpha_2/\alpha=0.93$), $H_H=164.8$ (mm), $a_1=-1520.9$, $b_1=1533.4$, $c_1=5.57\times10^{-4}$, $a_2=95.1$, $b_2=69.7$, $c_2=1.35\times10^{-2}$.

(2) Regarding the horizontal side walls 5 and 6: $2\alpha=40°$, $\alpha_4=18.6°$ ($\alpha_4/\alpha=0.93$), $T_V=20$ (mm), $W_V=347.5$ (mm), $\alpha_5=24.6°$ ($\alpha_5/\alpha=1.23$), $L_V=714.9$ (mm), $D_V=394.8$ (mm) ($D_V/L_V=0.55$), $a_3=20$, $a_4=-271.8$, $b_3=0.377$, $b_4=960.5$, $r=852.1$.

Next, various characteristics of examples of horns in accordance with the present invention will be explained hereinafter.

Figure 11A:
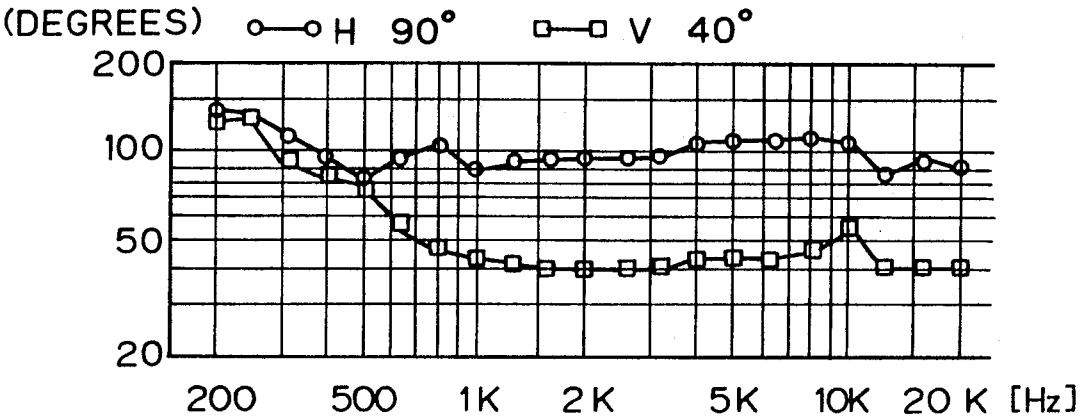
FIGS. 11*a*, 11*b* and 11*c* are graphs respectively showing directivity characteristics of three different types of horns according to the present invention.
Figure 11B:
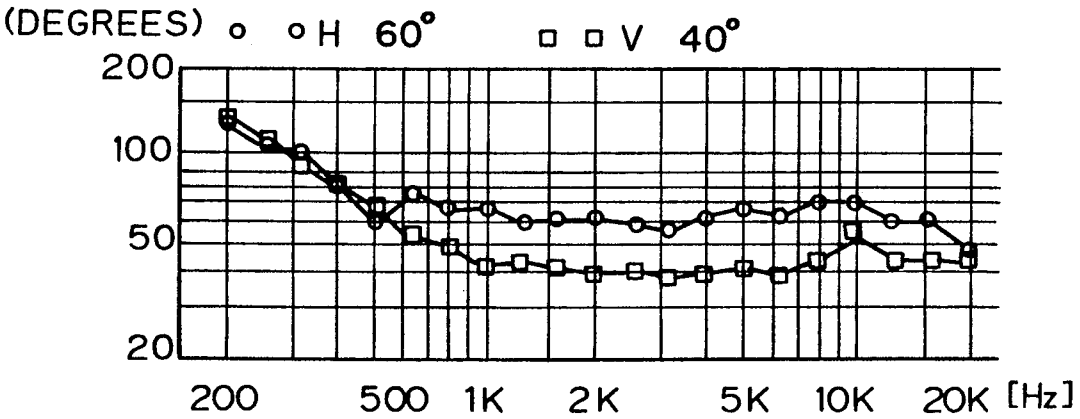
Figure 11C:
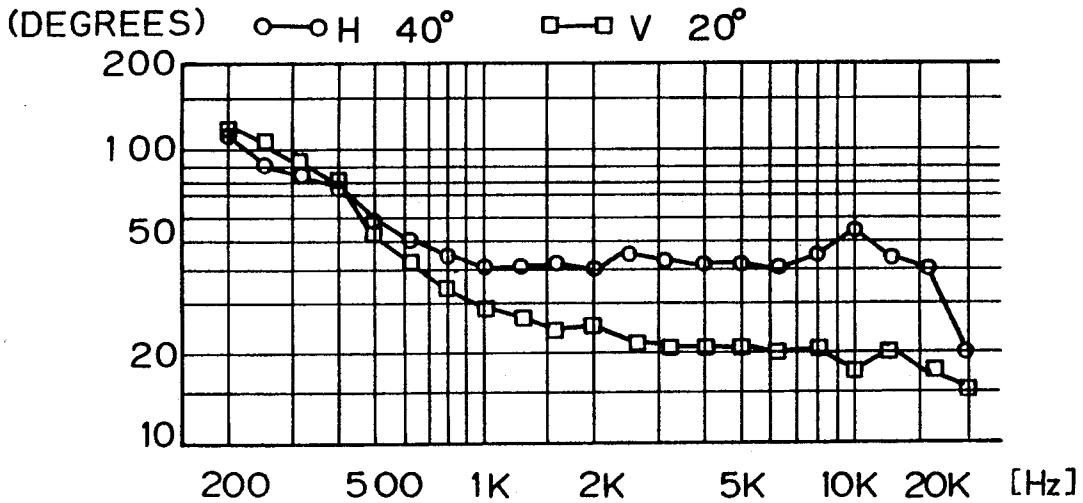
Figure 12:
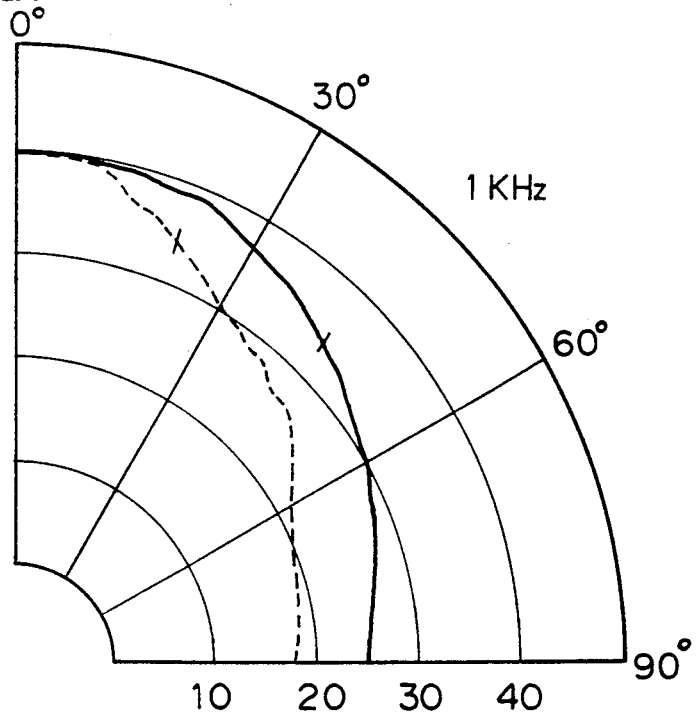
FIGS. 12*a*, 12*b*, 12*c* and 12*d* are polar pattern charts of a horn according to the present invention measured at different frequencies.
Figure 12:
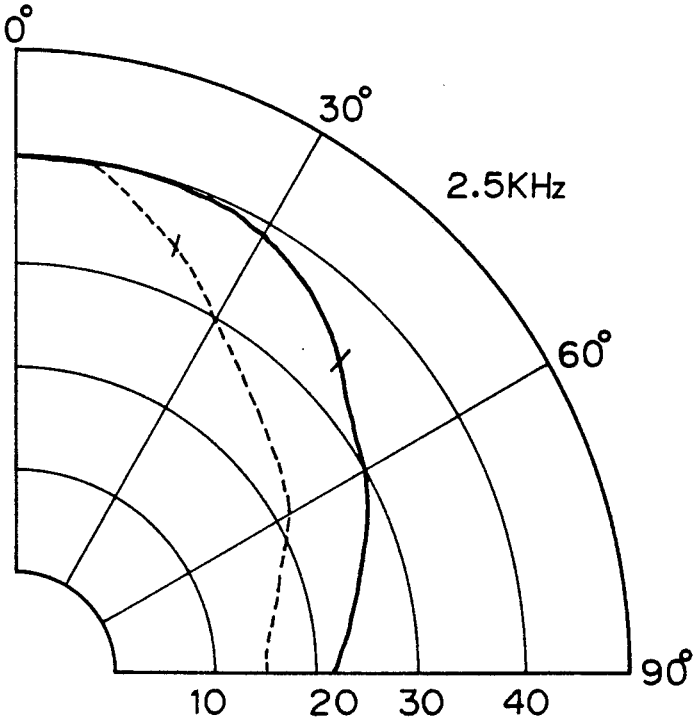
Figure 12:
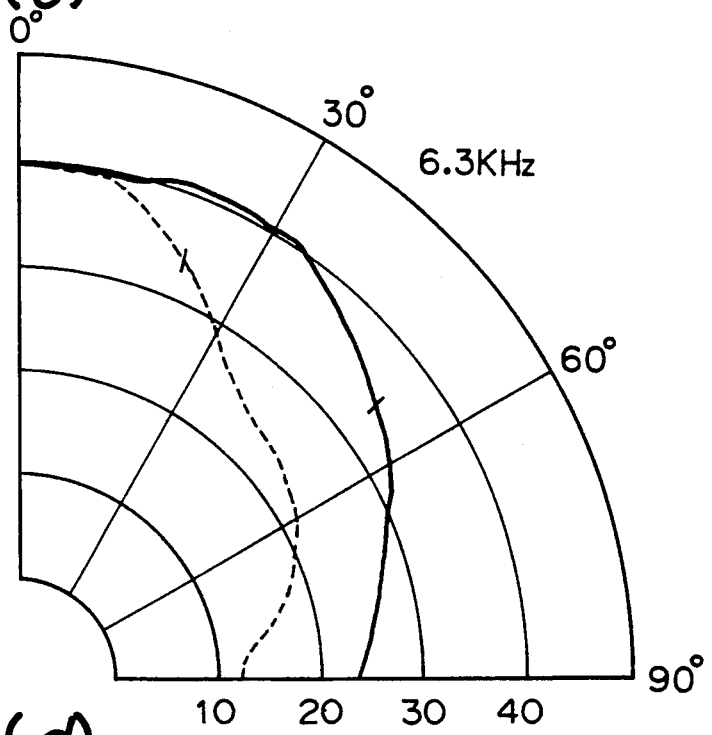
Figure 12:
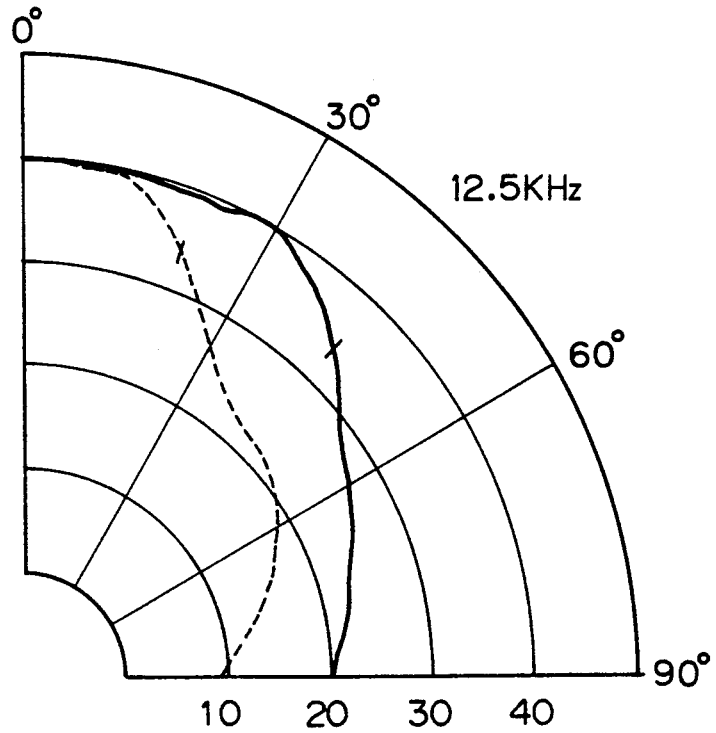

FIGS. 11*a*–11*c* illustrate graphs of measured data of directivity characteristics of three different types of horns according to the present invention; a horn having a horizontal directivity angle of 90 degrees and a vertical directivity angle of 40 degrees (FIG. 11*b*), a horn having a horizontal directivity angle of 60 degrees and a vertical directivity angle of 40 degrees (FIG. 11*b*) and a horn having a horizontal directivity angle of 40 degrees and a vertical directivity angle of 20 degrees (FIG. 11*c*). In these figures, horizontal directivities are designated by a symbol "○" and vertical directivities by "□". It can be understood from those graphs that the directivity characteristics of the horns are more approximate to predetermined design values with smaller dispersion and that a narrowing phenomenon in a low frequency range can be dissolved whereby a uniform directivity can be obtained over a wide frequency range, when the present invention is applied to control vertical directivity characteristics which require to be more accurately controlled. This is because the horizontal side walls of those horns are constructed such that sound waves are emitted more evenly from the side walls near the mouth by making the portions of the side walls near the mouth (about ½ of the total length) in the form of an arc.

FIGS. 12*a*–12*d* illustrate polar patterns of a horn according to the present invention having a horizontal directivity angle of 90 degrees and a vertical directivity angle of 40 degrees at frequencies of 1 KHz, 2.5 KHz, 6.3 KHz and 12.5 KHz, respectively. In these figures, horizontal patterns are designated by solid lines and vertical patterns by dotted lines.

FIGS. 13*a*, 13*b*, 14*a*, 14*b*, 15*a* and 15*b* illustrate the horizontal and vertical directivity angle characteristics of three different types of horns according to the present invention (shown by the symbol "○") and those of horns conventionally used (shown by the symbol "Δ").

Figure 13A:
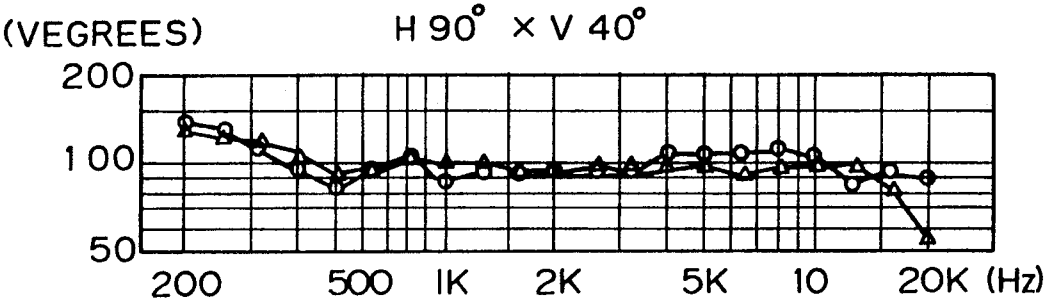
FIGS. 13*a* and 13*b*, 14*a* and 14*b* and 15*a* and 15*b* are graphs respectively showing directivity angle characteristics of three different types of horns according to the present invention in comparison with those of the prior art.
Figure 13B:
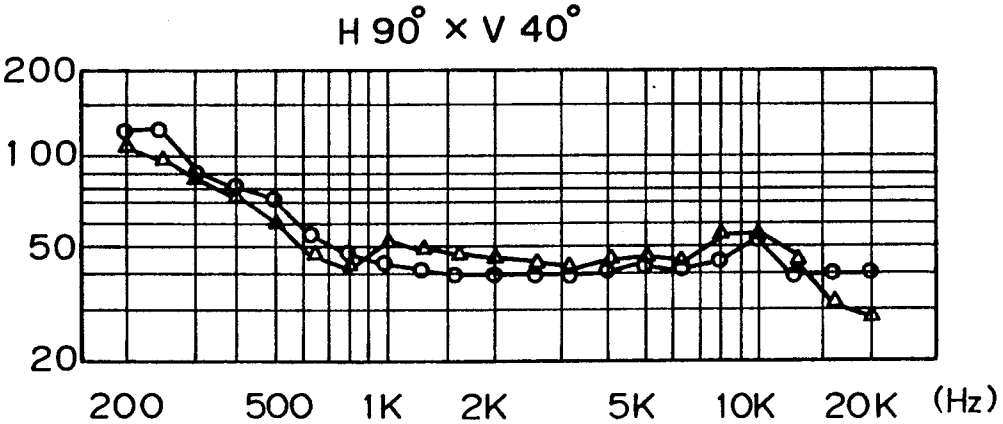

FIGS. 13*a* and 13*b* show horizontal and vertical directivity angle characteristics, respectively, of a horn according to the present invention and those of a conventional horn, these horns having a horizontal directivity angle of 90 degrees and a vertical directivity angle of 40 degrees. FIG. 13*a* indicates that the horizontal directivity angle of the horn according to the present invention is broader than that of the conventional horn in a frequency range from 4 KHz to 10 KHz, but is controllable in as high a frequency as 20 KHz. FIG. 13*b* indicates that the horn according to the present invention has characteristics more approximate to predetermined design values with smaller dispersion in a frequency range higher than 1 KHz, and that the horizontal directivity angle of this horn can be controllable as high as 20 KHz. Furthermore, in an operating frequency range from 630 Hz to 16 KHz, an average value and a deviation of the directivity angle of the horn according to the present invention are 43 degrees and 15 degrees, respectively, which means that this horn is more excellent than the prior art.

Figure 14:
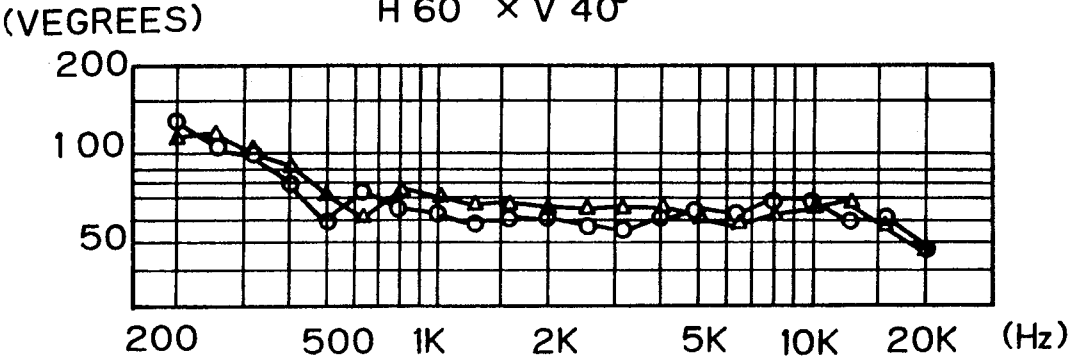
Figure 14:
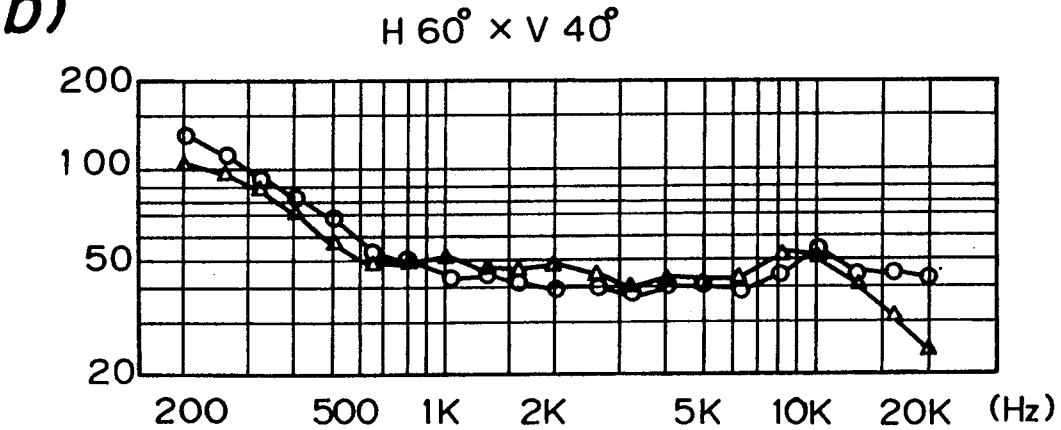

FIGS. 14*a* and 14*b* show horizontal and vertical directivity angle characteristics, respectively, of a horn according to the present invention and those of a conventional horn, these horns having a horizontal directivity angle of 60 degrees and a vertical directivity angle of 40 degrees. FIG. 14*a* indicates that the horn according to the present invention has characteristics more close to predetermined design values and a lower dispersion rate in a frequency range higher than 800 Hz. The average value and deviation of the directivity angle of the horn according to the present invention are 64 degrees and 19 degrees, respectively, and show an improvement over those of the conventional horn. FIG. 14*b* indicates that the vertical directivity angle of the horn according to the present invention is almost equal to a design value in a frequency range higher than 1 KHz, has a low rate of dispersion and is controllable in as high a frequency as 20 KHz. The average value and deviation of the directivity angle are 44 degrees and 18 degrees, respectively, and show an improvement over those of the conventional horn.

Figure 15:
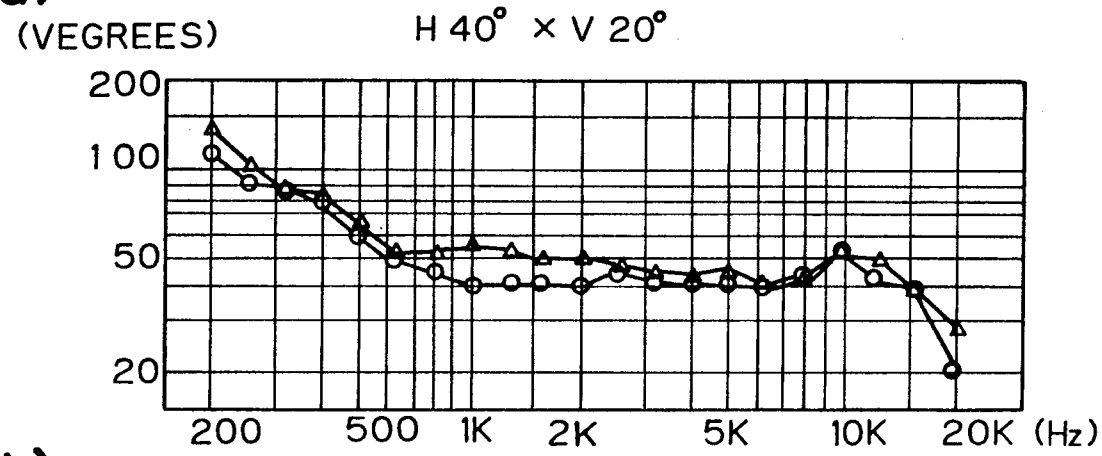
Figure 15:
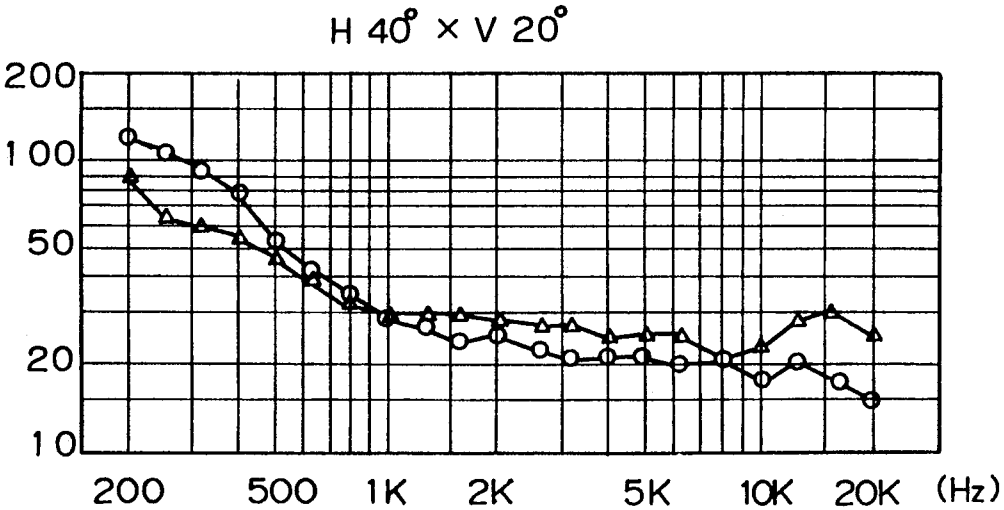

FIGS. 15*a* and 15*b* show horizontal and vertical directivity angle characteristics, respectively, of a horn according to the present invention and those of a conventional horn, these horns having a horizontal directivity angle of 40 degrees and a vertical directivity angle of 20 degrees. FIG. 15*a* indicates that the horizontal directivity angle of the horn according to the present invention is more approximate to a design value, that is, an objective directivity angle and is more even in a low frequency range to 16 KHz than that of the conventional horn. The average value and deviation of the directivity angle of the horn according to the present invention are 43 degrees and 14 degrees, respectively, and show an improvement over those of the conventional horn. FIG. 15*b* indicates that the vertical directivity angle of the horn according to the present invention is almost equal to a design value and more even in a frequency range from 1 KHz to 16 KHz. The average value and deviation of the directivity angle of this horn are 22 degrees and 11 degrees and better than those of the conventional horn.

It can be understood from such data as described above that the horns according to the present invention have directivity angles more approximate to nominal values (design values) and lower rate of deviation than the conventional horns. In particular, the vertical directivity angles of the horns according to the present invention show an improvement over those of the conventional horns and controllable as high as 20 KHz in the case where the vertical directivity angle is 40 degrees. This is because the vertical directivity angle is brought about by the horizontal side walls having a shape formed from a combination of a straight line and an arc in accordance with the present invention.

Figure 16:
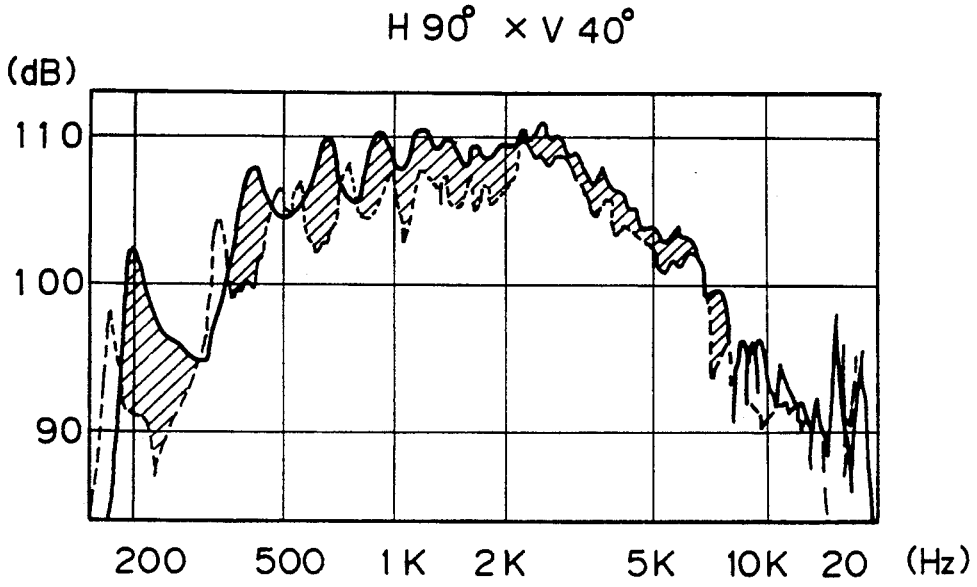
FIGS. 16 and 17 are graphs respectively showing frequency characteristics of two different types of horns according to the present invention in comparison with those of the prior art.
Figure 17:
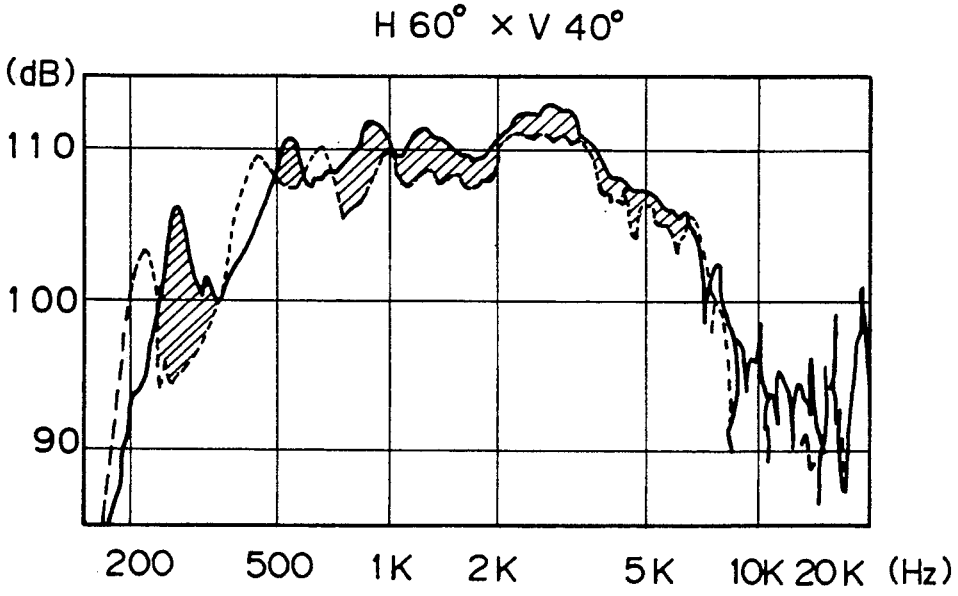

FIG. 16 illustrates frequency characteristics of a horn according to the present invention (shown by a solid line) and those of conventional horns (shown by a dotted line), these horns having a horizontal directivity angle of 90 degrees and a horizontal directivity angle of 40 degrees and being driven by the same driver unit. Also, FIG. 17 illustrates frequency characteristics of a horn according to the present invention (shown by a solid line) and those of a conventional horn (shown by a dotted line), these horns having a horizontal directivity angle of 60 degrees and a vertical directivity angle of 40 degrees and being driven by the same driver unit. In these figures, areas shown by slanted lines indicate that the horns according to the present invention have higher output sound pressures than the conventional horns.

It can be clearly understood from FIGS. 16 and 17 that the horns according to the present invention perform far better in a frequency range from 500 Hz to 2 KHz than the conventional horns. This indicates that the horns according to the present invention have high radiation resistances in this frequency range, which is brought about by constructing the vertical side walls in a shape defined by a combination of constant and exponential terms and conforming the shape of the mouth edge with an equiphase front of an emitted sound wave.

As seen from such comparisons of the directivity angle control characteristics and frequency characteristics as described above, it can be recognized that horns having a construction according to the present invention are more excellent than conventional horns. Such excellency is due to the fact the horns according to the present invention can be accurately designed and that the side walls and the mouth of horns can be formed.

The invention has been described in detail with particular reference to certain preferred embodiments thereof, but it will be understood that variations and modifications can be effected within the spirit and scope of the invention.

What is claimed:

1. A speaker horn having a central axis along which a sound wave propagates and including first and second pairs of opposing side walls substantially perpendicular to one another, wherein said first pair of opposing side walls has first and second sections between first and second ends, said second section being connected to said first section, said first end being coupled to a driver unit and said second end defining a mouth of said horn, said first and second sections having, in a plane including the central axis of said horn and perpendicular to said side walls of said first pair, differing exponential shapes, said second pair of opposing side walls having the same shape as said first pair of opposing side walls.

2. A speaker horn having a central axis along which a sound wave propagates and including first and second pairs of opposing side walls substantially perpendicular to one another, said second pair of opposing side walls having third and fourth sections between third and fourth ends, said fourth section being connected to said third section, wherein said third end of said second pair of opposing side walls is coupled to a driver unit, said fourth end of said second pair of opposing side walls defining a mouth of said horn, wherein said second pair of opposing side walls is, in a plane including the central axis of said horn and perpendicular to said second pair of opposing side walls, linear in said third section and an arc of a circle in said second section, and wherein said second section curves outward from the central axis, said second pair of opposing side walls having the same shape as said first pair of opposing side walls.

3. A speaker horn having a central axis along which a sound wave propagates and including first and second pairs of opposing side walls substantially perpendicular to one another, said first pair of opposing side walls having first and second sections, said second section connected to said first section between first and second ends, said second pair of opposing side walls has a third section and a fourth section connected to said third section between third and fourth ends, said first and third ends being coupled to a driver unit and said second and fourth ends forming a mouth of said horn, wherein said first and second sections of said first pair of opposing side walls have, in a first plane including the central axis of said horn and perpendicular to said side walls of said first pair, differing exponential shapes, said second pair of opposing side walls is, in a second plane including the central axis of said horn and perpendicular to said side walls of said second pair, linear in said third section and an arc of a circle in said fourth section, and wherein said fourth section curves outward from the central axis.

4. A horn as claimed in claim 3 wherein the shape of said mouth of said horn is in conformity with an equiphase line of a sound wave propagating inside said horn.

5. A horn as claimed in claim 4 further comprising a transacting section located between said driver unit and a slit of said horn having a slit width when said driver unit has a larger throat diameter than said slit width of said horn.

6. A speaker horn including first and second pairs of opposing side walls substantially perpendicular to one another and defining a central axis therebetween, the first pair of opposing side walls having first and second sections being connected together at a connection point, said first section having a first end being coupled to a driver unit and defining a slit width therebetween, said second section having a second end defining a mouth of said horn with the space therebetween defining a horizontal mouth length, the slit width defined by, $$T_H \leqq 103.8/(F_H \cdot \sin\alpha)$$

where $T_H$ is one half the horizontal width of the slit, $\alpha$ is the directivity, and $F_H$ is the high limit frequency, the horizontal mouth being defined by, $$W_H \geqq 103.8/(F_L \cdot \sin\alpha)$$

where $W_H$ is one half the horizontal mouth length and $F_L$ is the low limit frequency, the shape of the first and second sections being defined by the following equations, $$y_1 = a_1 + b_1 \cdot e^{c_1 x}$$

$$y_2 = a_2 + b_2 \cdot e^{c_2 x}$$

$$L_H = W_H/\tan \alpha_3 - P_H \text{ where } P_H = T_H/\tan \alpha_1$$

$$D_H/L_H = 0.56 \sim 0.62$$

$$H_H = (D_H + P_H) \tan \alpha_2$$

$$\frac{1}{D_H} \cdot \ln\left(\frac{H_H - T_H}{b_1} + 1\right) - \frac{\tan \alpha_1}{b_1} = 0.$$

$$a_1 = T_H - b_1$$

$$c_1 = \tan \alpha_1 / b_1$$

$$\frac{1}{L_H - D_H} \cdot \ln\left(\frac{W_H - H_H}{b_2} + 1\right) - \frac{b_1 c_1 \cdot e^{C_1 D_H}}{b_2} = 0$$

$$a_2 = H_H - b_2$$

$$c_2 = b_1 c_1 \cdot e^{c_1 D_H} / b_2$$

wherein, $$\alpha_1/\alpha = 0.87 \sim 0.90$$

$$\alpha_2/\alpha = 0.90 \sim 0.95$$

$$\alpha_3/\alpha = 1.17 \sim 1.21$$

where $y_1$ and $y_2$ define the shape of the first and second sections respectively, x is defined along the central axis of said horn, $a_1$, $b_1$, $c_1$, $a_2$, $b_2$, and $c_2$ are constants, $\alpha_1$ is an angle between the central axis of said horn and a line tangent to one of said opposing side walls at said first end, $\alpha_2$ is an angle between the central axis and a line interconnecting the connecting point and an intersection of the central axis of said horn and the line tangent to the first pair of side walls at said first end, $\alpha_3$ is an angle between the central axis of said horn and a line interconnecting said intersection and an end point of said second section at said second end, $D_H$ is the length of said first section along the central axis of said horn, and $L_H$ is the length along the central axis of said horn between said first and second ends.

7. The speaker horn of claim 6 wherein the second pair of opposing side walls has the same shape as the first pair of opposing side walls.

8. The speaker horn of claim 6 wherein the second pair of opposing side walls have third and four sections, the third section being linear and the fourth section being arcuate.

9. The speaker horn of claim 6 wherein the second pair of opposing side walls has third and fourth sections between third and fourth ends, said third end of said second pair of opposing side walls being coupled to the driver unit, the space between the second pair of opposing side defining a vertical slit width at the third end and a vertical mouth length $$T_V \leqq 103.8/(F_H \cdot \sin \alpha)$$

where $T_v$ is one half the vertical slit width, the vertical mouth length of the horn mouth being defined by, $$W_V \geqq 103.8/(F_L \cdot \sin \alpha)$$

where $W_v$ is one half the vertical mouth length of the horn, the shape of the third and fourth sections being defined by the following equations, $$y_3 = a_3 + b_3 X$$

$$y_4 = b_4 \pm \sqrt{\gamma^2 - (x - a_4)^2}$$

$$\alpha_4/\alpha = 0.90 \sim 0.95$$

$$\alpha_5/\alpha = 1.21 \sim 1.28$$

$$L_V = W_V/\tan \alpha_5 - P_V \text{ where } P_v = T_v/\tan \alpha_3$$

$$D_V/L_V = 0.52 \sim 0.57$$

where $y_3$ and $y_4$ define the shape of the third and four sections respectively, x is the central axis of said horn, $a_3$, $b_3$, $a_4$, and $b_4$ are constants, $\alpha_4$ is the angle between the central axis of said horn and the third section, $\alpha_5$ is the angle between the central axis and a line interconnecting the fourth end and the intersection of a line along the third section and the central axis, $D_v$ is the length of said first section along the central axis of said horn, and $L_v$ is the length along the central axis of said horn between said first and second ends.

* * * * *